US005653058A

United States Patent [19]

Zaimins

[11] Patent Number: 5,653,058

[45] Date of Patent: Aug. 5, 1997

[54] RAILROAD GATE ARM SWIVEL ADAPTER SPRING ASSEMBLY

[75] Inventor: Jerry J. Zaimins, Park Ridge, Ill.

[73] Assignee: Western-Cullen Hayes, Inc., Chicago, Ill.

[21] Appl. No.: 560,283

[22] Filed: Nov. 17, 1995

[51] Int. Cl.[6] ..... E05D 15/56

[52] U.S. Cl. ..... 49/208; 49/34; 49/49

[58] Field of Search ..... 49/208, 49, 35, 49/34

[56] References Cited

U.S. PATENT DOCUMENTS 4,227,344 10/1980 Poppke ..... 49/34 X 4,531,325 7/1985 Phillips ..... 49/49

4,655,002 4/1987 Everson ..... 49/49 X 5,442,878 8/1995 Flores ..... 49/208

*Primary Examiner*—Philip C. Kannan

*Attorney, Agent, or Firm*—Banner & Witcoff, Ltd.

[57] ABSTRACT

A railway gate arm assembly including a gate arm which is mounted to permit pivoting about a longitudinal axis when an external force is applied to the gate arm thereby causing the latter to swivel out of a vertical plane, and at least two torsion springs, one mounted on each side of the gate arm and having depending spring legs which engage against corresponding sides of the gate arm and bias the gate arm to a vertical position so if the gate arm is caused to swivel out of a vertical plane by an external force, it will be returned to the vertical plane by the depending spring legs when the external force is removed.

14 Claims, 4 Drawing Sheets

FIG. 7
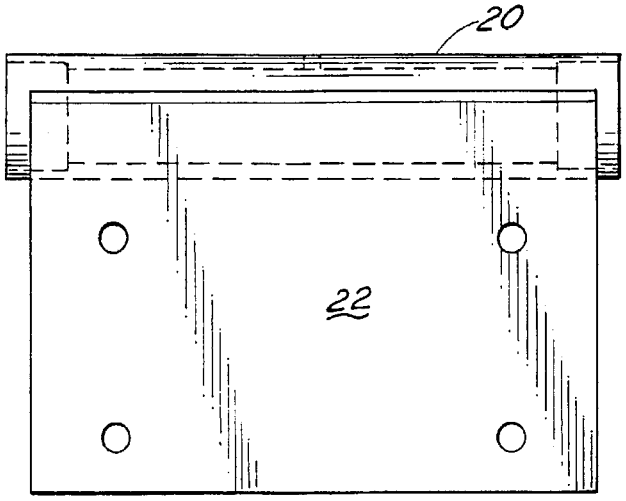
FIG. 6
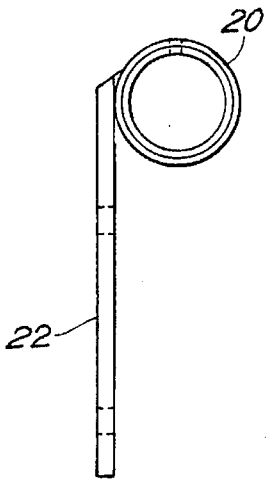
FIG. 11
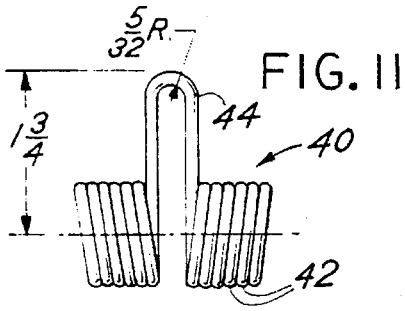
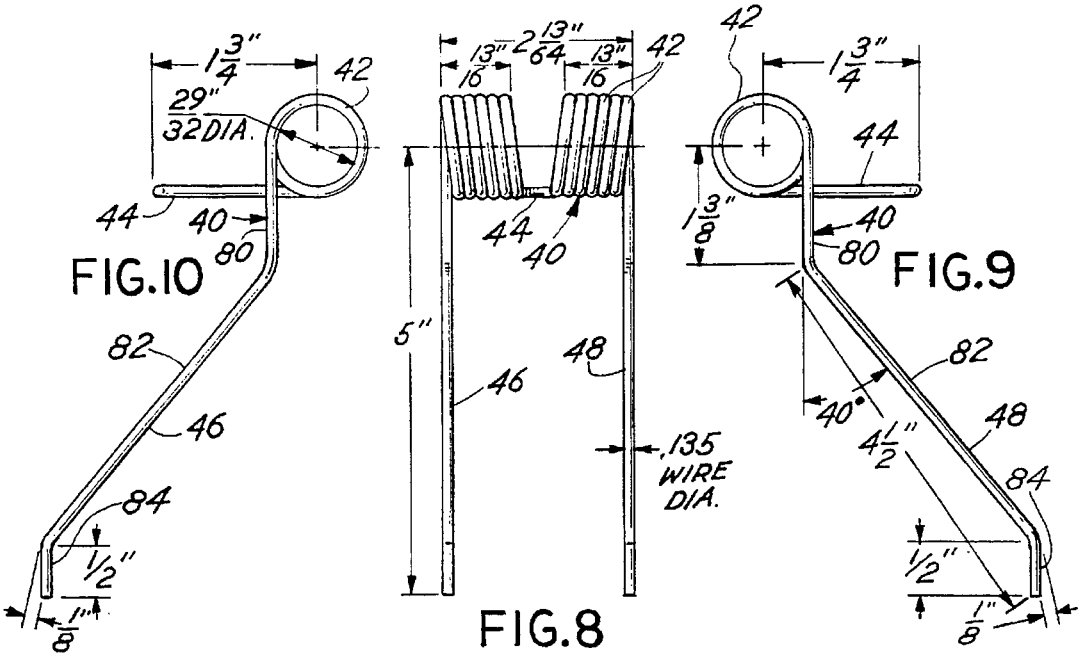
FIG. 10
FIG. 8
FIG. 9

RAILROAD GATE ARM SWIVEL ADAPTER SPRING ASSEMBLY

BACKGROUND OF THE INVENTION

FIELD OF THE INVENTION

The present invention relates to a railroad gate arm which is used at railroad crossings and operated so as to be lowered to a horizontal position to block traffic when a train is present and to be raised to an upright or retracted position when no train is present.

More particularly, the invention relates to a swivel type gate arm which is designed to pivot about a longitudinal axis when an external force is applied to the gate arm. Such known swivel mechanism is in addition to the well known breakaway mechanism which is normally incorporated in gate arm support members so that if a car or truck engages the gate arm head on, the arm will break away without destroying the relatively expensive support mechanism which supports the gate arm and raises and lowers the same.

A swivel type gate arm is disclosed in U.S. Pat. No. 5,442,878. In FIG. 2 of the foregoing patent, there is shown a gate arm 22 which is fixedly secured to a swivel bracket 46, the swivel bracket 46 being supported on a pin-like member 44 shown extending from a conversion bracket 42. The gate arm 22 pivots up and down about an axis (not numbered) which is located at the center of a motor 41. In addition, the bracket 46 can rotate or swivel about the gate adapter 44 with the result that when an external force is applied, the gate arm 22 can swivel about the axis of gate adapter 44. The purpose of allowing the gate arm to swivel about the axis of gate adapter 44 upon application of an external force is to reduce breakage of the gate arm, whether such external force is caused by high wind or due to contact with the top of a vehicle.

The swivel gate arm disclosed in the foregoing '878 patent is intended to be maintained in a preferred position in an upright plane due to gravity. However, such mechanism has been found to be unsatisfactory. Thus, it is an object of the present invention to provide a swivel adapter spring assembly which will reliably return a gate arm to an upright plane in the absence of external forces which are strong enough to overcome the spring force.

It is a further object of the invention to provide a spring assembly which is highly advantageous and uniquely qualified to control the position of a swivel type gate arm without need to rely upon gravity.

The foregoing objects and advantages of the invention will be apparent from the following description of a preferred embodiment thereof, taken in conjunction with the accompanying drawings.

DESCRIPTION OF THE DRAWINGS

FIG. 6 is an end view of a swivel bracket weldment comprising a rectangular plate which is welded to a length of tube along one edge of the plate, the swivel bracket weldment being a component of the assembly of FIGS. 1–3;

FIG. 7 is a side elevational view of the swivel bracket weldment of FIG. 6;

FIG. 8 is a side elevational view of a spring element, there being four such spring elements incorporated in the spring assembly of FIGS. 1–3;

FIG. 9 is an end view of the spring element of FIG. 8;

FIG. 10 is an opposite end view of the spring element of FIG. 8; and

FIG. 11 is a top plan view of the spring element of FIG. 8.

Now, in order to acquaint those skilled in the art with the manner of making and using my invention, I shall describe, in conjunction with the accompanying drawings, a preferred embodiment of the invention.

DETAILED DESCRIPTION OF THE INVENTION

Figure 1:
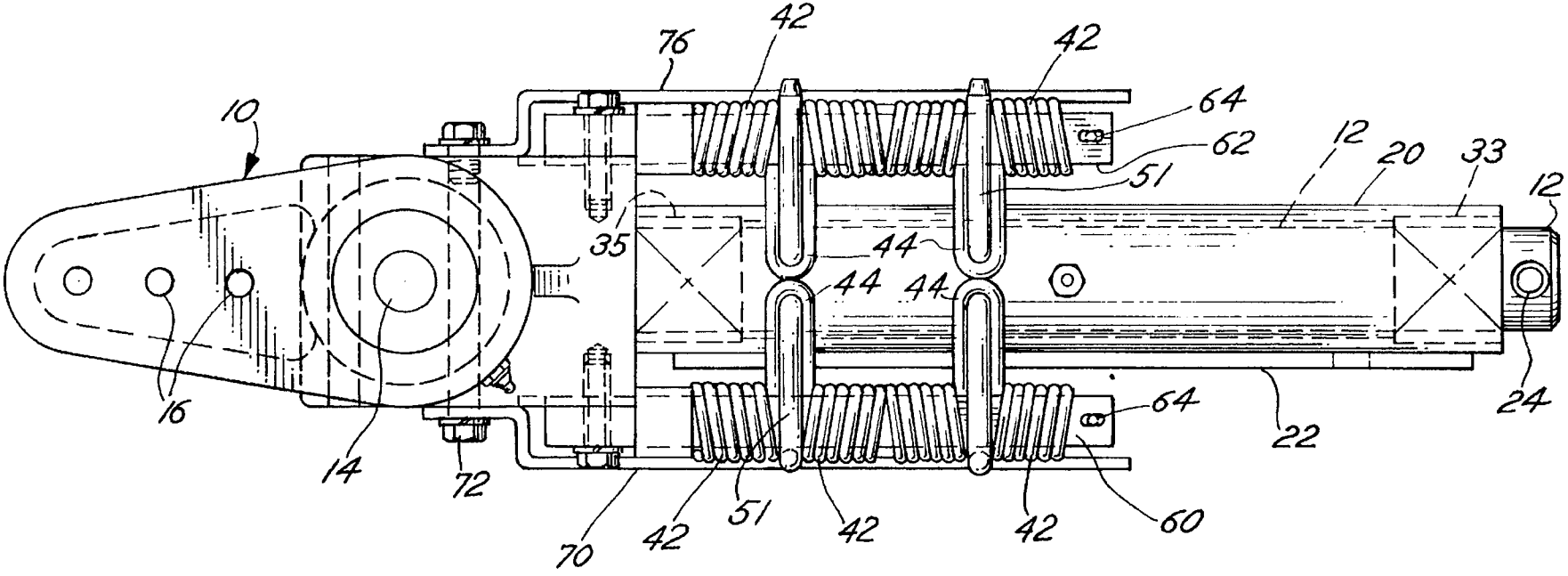
FIG. 1 is a top plan view of the spring assembly of the present invention together with a swivel bracket and rod assembly.
Figure 4:
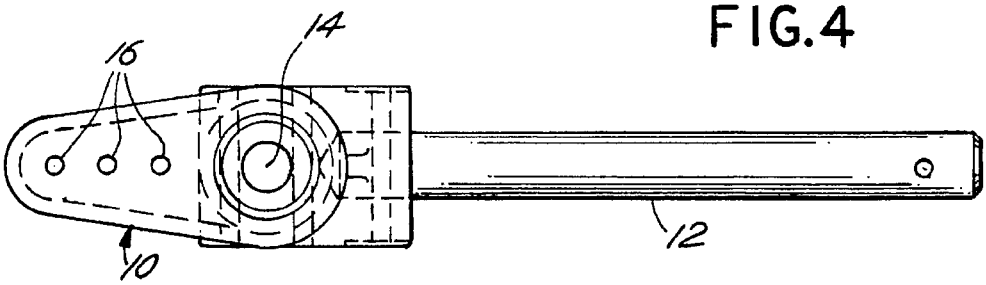
FIG. 4 is a top plan view of a swivel bracket and rod assembly which is a component of the assembly of FIGS. 1–3.
Figure 5:
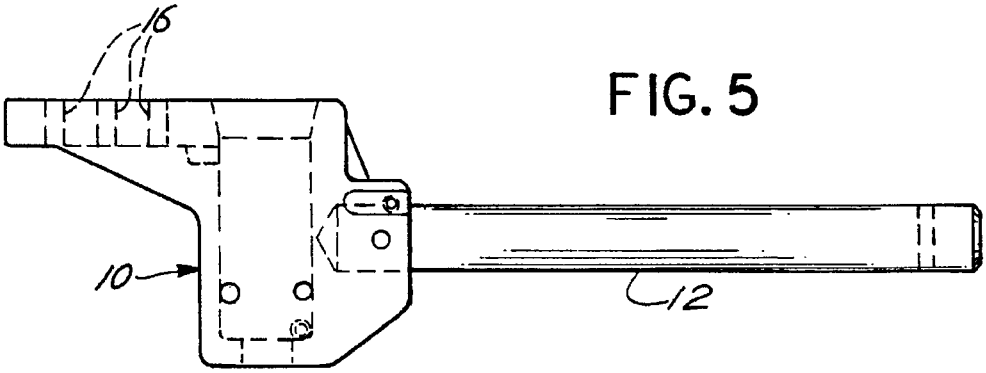
FIG. 5 is a side elevational view of the assembly of FIG. 4.

FIG. 1 is a top plan view showing a swivel bracket 10 which is assembled with a rod 12 to create a swivel bracket assembly best shown in FIGS. 4 and 5. The swivel bracket pivots about an upright pin shown at 14 in FIG. 1, and the bracket is held in a normal operative position relative to pin 14 by three shear pins shown at 16 in FIG. 1. The foregoing structure comprises known breakaway mechanism designed to break if a horizontal force engages against the gate arm, as when a vehicle hits the gate arm when the latter is in a down or horizontal position blocking traffic at a gate crossing.

Thus, when a horizontal force engages the gate arm, it will tend to pivot the latter including the swivel bracket 10 about the pin 14, and if the force is sufficient to break the three shear pins 16, the gate arm will pivot freely away and thereby avoid damage to the gate mechanism. Such breakaway mechanism is known, and of course the number and size of the shear pins 16 may be adjusted to control the force needed to effect breakaway of the gate arm.

Certain known structure is not shown in FIG. 1, such as mechanism for supporting the upright pin 14, and mechanism for raising and lowering the gate arm between an upright, retracted position and a lowered, horizontal position where it blocks vehicles. The horizontal axis about which the gate arm and swivel bracket 10 pivot up and down is not shown in FIG. 1 but is located to the left of the swivel bracket 10.

FIGS. 6 and 7 show a swivel bracket weldment which is the structure for supporting a gate arm on the rod shown at 12 in FIG. 1. The swivel bracket weldment includes a tube 20 which is welded to a rectangular plate 22, and as shown in FIG. 3, the tube 20 is mounted over the rod 12 and a keeper pin 24 (see FIGS. 1–3) is placed through a hole in the outer projecting end of rod 12 to prevent tube 20 from sliding off rod 12.

Figure 2:
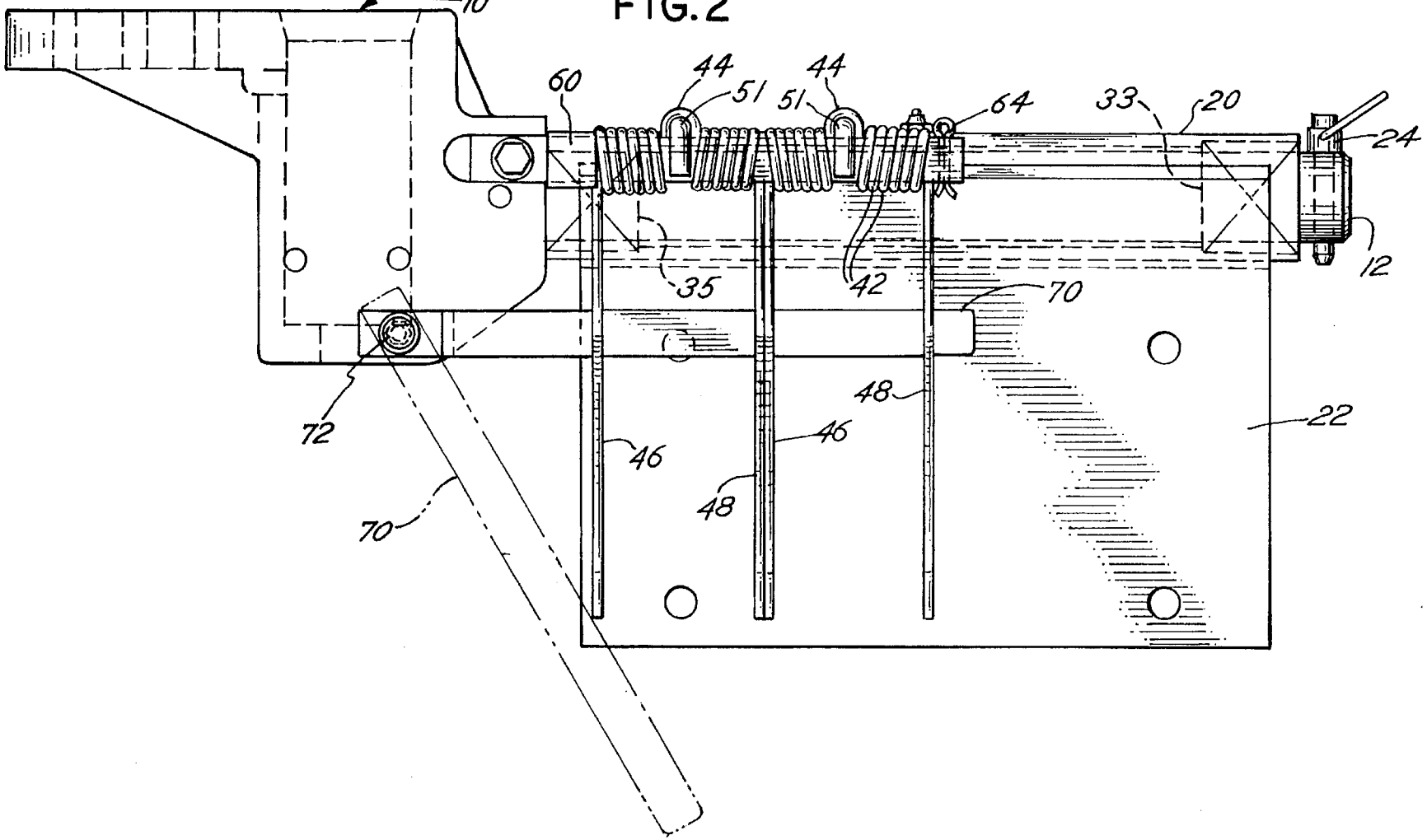
FIG. 2 is a side elevational view of the spring assembly of FIG. 1.
Figure 3:
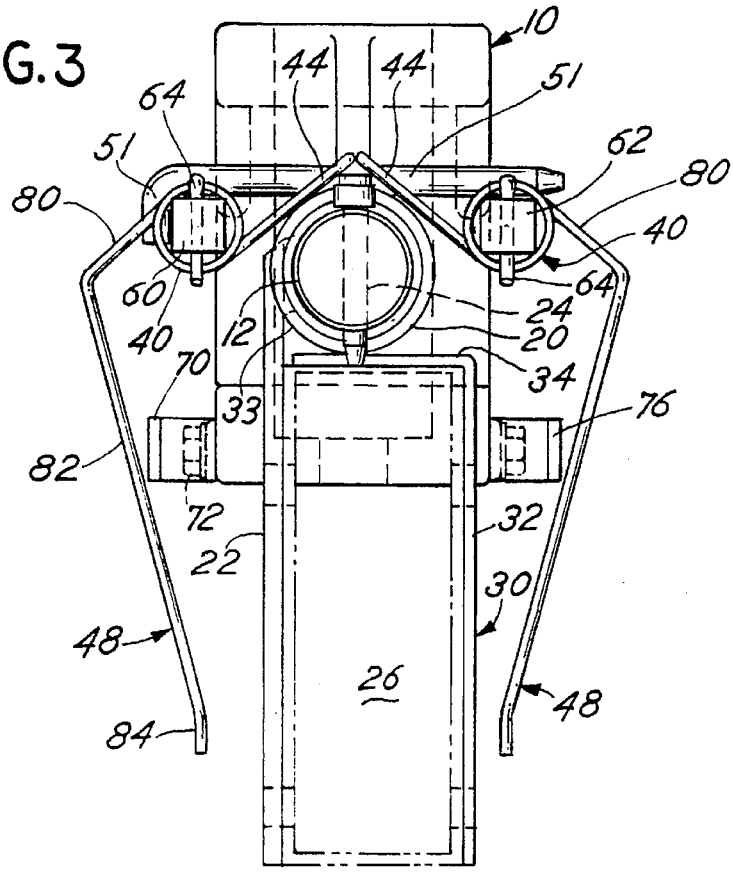
FIG. 3 is an end view of the spring assembly of FIG. 1.

In its normal position as shown in FIGS. 1–3, the plate 22 is vertically positioned. FIG. 3 shows an end view of a gate arm 26 which is fastened to the inside of plate 22 by known fastening means. FIG. 3 also shows an L-shaped metal spacer plate 30 having a vertical plate portion 32 and a top or horizontal plate portion 34. The plate 30 is fastened to a side of the gate arm 26 opposite the plate 22 so that the gate arm has the metal plates 22 and 32 on opposite sides thereof. As previously explained, the plate 22 together with the tube 20 supports the gate arm 26 on the rod 12. In addition, the plates 22 and 32 are made of a material suitable to protect the gate arm. For example, if the gate arm is made of aluminum or fiberglass, the plates 22 and 32 may be made of steel.

I will now describe the spring elements which have been designed to control the normal position of the gate arm 26, i.e., to return it to a vertical plane shown in FIGS. 1–3 without need to rely on gravity after removal of an external force which has caused the gate arm to swivel out of its vertical plane. In the absence of such spring elements, the gate arm (see FIG. 3) which is fixed to plate 22 and tube 20 is free to pivot or swivel about the axis of rod 12, since the tube 20 is loosely mounted over rod 12 and can rotate thereon. In fact, FIG. 1 shows a pair of bronze or brass bushings 33 and 35 which are mounted inside opposite ends of the tube 20 and facilitate rotation of tube 20 on rod 12 by reducing friction between them.

FIGS. 8–11 show a single spring element 40 having six coils 42 on each side of a loop 44. The spring element 40 also includes a pair of depending legs 46 and 48 which extend generally downwardly from opposite ends of the spring element. As will be explained later, the two depending legs 46 and 48 are positioned to engage against the side of one of the gate arm plates 22 and 32 (see FIG. 3) to control the swivel position of the gate arm 26. Also, as will be more fully explained later, the center loop portion 44 is used to create a desired torsion in the spring element 40 so that the depending legs 46 and 48 will engage against the sides of gate arm plates 22 and 32 with a desired equal and opposite force.

As shown in FIGS. 8–11, the spring loop 44 is at rest in a horizontal position. However, as shown in FIG. 3, the loops 44 are maintained at an angle substantially inclined above the horizontal as installed, which causes legs 46 and 48 to be moved inwardly to apply forces on opposite sides of the gate arm plates 22 and 32 to forcibly maintain the gate arm 26 in a vertical plane in the absence of an external force sufficient to overcome the torsion force of the spring elements.

In the particular embodiment shown in FIGS. 1–3, four of the spring elements 40 are utilized to control the plane of gate arm 26. The four spring sets 40 are mounted on a pair of extension bars 60 and 62 which are supported at one end from the swivel bracket 10. FIG. 3 is an end view of the extension bars 60 and 62 which are square in cross section and dimensioned so the twelve coils 42 of each spring set can be slid over one of the extension bars.

Referring now to FIG. 2, one of the extension bars 60 is shown supported at its left end from the swivel bracket 10 and extending horizontally a length sufficient to receive the twelve coils 42 from each of two of the spring sets 40 which are positioned end-to-end on bar 60. Each of the spring sets 40 has a loop 44, and each has a pair of depending legs 46 and 48. A spring retainer pin 64 is fitted through a hole in the outer end of extension bar 60 to retain the two spring sets thereon.

FIG. 3 shows that when the spring sets 40 are installed, the loop members 44 are raised above their at rest or horizontal positions as shown in FIGS. 9 and 10, and are maintained in such raised positions by a spring keeper 51 which extends laterally over two opposed sets of spring coils 42 and underneath a pair of adjacent loops 44 to hold the loops in their elevated positions. FIG. 2 shows a pair of spring keepers 51 which extend laterally under the spring loops 44 of end-to-end spring sets 40. The keepers 51 extend over the tube 20 so as to be supported by the latter.

In the foregoing manner, two spring keepers 51 are sufficient to maintain four of the spring loops 44 in their raised positions because, as shown in FIG. 3, a single spring keeper extends laterally beneath two of the loops 44. FIG. 1 is a top plan view showing the pair of spring keepers 51 which extend beneath the loops 44. Because loops 44 are thus installed in raised positions, the downwardly extending legs 46 and 48 are biased inwardly to exert equal and opposite forces on the two sides of gate arm 26 through engagement with gate arm plates 22 and 32.

FIG. 1 shows the two extension bars 60 and 62 supported at their left ends from the swivel bracket 10, it shows the two spring sets 40 mounted on the first extension bar 60 as previously described in conjunction with FIG. 2, and it shows a third and fourth spring set 40 mounted on the second extension bar 62. The two spring sets 40 mounted on each of the extension bars 60 and 62 are mounted in end-to-end engagement so the coils 42 are in abutting relation. Since each spring set 40 has twelve coils, the total spring assembly shown in FIGS. 1–3 comprises forty-eight coils. However, the number of spring sets used in the spring assembly and the dimensions of individual spring sets may be varied to provide a desired spring force on the gate arm.

FIG. 3 shows an end view where the two depending spring legs 48 are shown. However, as previously described, each spring set 40 has two depending legs 46 and 48, and since the preferred embodiment shown in FIGS. 1–3 includes two spring sets on each side of the gate arm 26, there are four depending spring legs for engagement against each side of the gate arm as shown in FIG. 2.

I will now describe a pair of spring retainers which are used for the purpose of temporarily maintaining the depending spring legs 46 and 48 spaced outwardly from the sides of the gate arm plates 22 and 32 until assembly of the gate arm mechanism is completed, after which the spring retainers are pivoted to release positions and the depending spring legs then firmly engage against the sides of the gate arm plates 22 and 32.

Referring to FIG. 2, a spring retainer 70 is shown in solid lines in its horizontal position and in dotted lines in its downwardly inclined or release position. The spring retainer 70 is pivotally mounted at its left end by a nut and bolt 72 to the swivel bracket 10. When the spring retainer 70 is in its horizontal position, it maintains the depending spring legs 46 and 48 outwardly and spaced from the sides of the gate arm plate 22. Similarly, when a spring retainer 76 mounted on the opposite side of the gate arm in its horizontal position, it maintains the depending spring legs 46 and 48 on that side of the gate arm in spaced relation to the gate arm plate 32.

When the gate arm 26 is to be assembled on the rod 12, the two spring retainers 70 and 76 are positioned in their horizontal positions as shown in FIG. 3 and shown in solid lines in FIG. 2. In that position of the spring retainers 70 and 76, with the depending spring legs 46 and 48 held outwardly as shown in FIG. 3, the gate arm 26 including the plate 22 fastened on one side thereof and the spacer plate 30 fastened on the opposite side thereof, is assembled by sliding the tube 20 over the rod 12 as previously described, and inserting the keeper pin 24 in the outer end of rod 12. Thereafter, the two spring retainers are manually moved to their downwardly inclined or release positions which permits all of the four depending spring legs 46 and 48 on each side of the gate arm to engage firmly against the gate arm plates 22 and 32 to maintain the gate arm in its normal vertical plane. The spring retainers may be manually pivoted by loosening the nut member 72 and may be fixed in a desired horizontal or lowered position by tightening the nut member 72.

Referring again to FIGS. 8–11 which illustrate a preferred form of torsion spring for use in the present invention, the spring 40 shown has twelve coils 42, one loop portion 44 and a pair of depending legs 46 and 48, all as previously described. As shown on the drawings, the wire diameter is 0.135 inch, the inside diameter of the spring coils is 9/32nds inch, the inside radius of the loop 44 is 5/32nds inch, the longitudinal length of each set of six coils is 13/16ths inch, and the vertical length of each depending spring leg measured from the centerline of the coils is 5 inches. Additional dimensions are shown in the FIGS. 8–11, including a 4½ inch dimension for the length of a leg 46 and 48. A preferred range of dimensions for the spring 40 is a range of plus or minus 50% from the specific dimensions shown in the drawings and set forth above, although a still more preferred range is plus or minus 25%.

Another important feature of the spring member 40 relates to the shape of each depending leg 46 and 48 which is best shown on the left side of FIG. 3 which depicts the spring in its installed position with the loop 44 bent in a counterclockwise direction from its at rest position as shown in FIG. 3. In the installed position, the spring leg 48 has a portion 80 which extends generally outwardly away from the gate arm plate 22 to provide room to accommodate the spring retainer 70, and a second portion 82 which is inclined generally inwardly toward the gate arm plate 22. The lowermost portion 84 of the spring leg 48 is approximately vertical and it is that portion which engages the side of gate arm plate 22 when the spring retainer 70 is pivoted to its lower, inoperative position.

In operation, referring to FIGS. 1–3, and in particular to FIG. 3, the four depending spring legs 46 and 48 on each side of gate arm 26 control the swivel position of the gate arm because, in the absence of such equal and opposite springs, the gate arm would be free to swivel with the tube 20 about the axis of rod 12. In the absence of external forces, the two spring elements 40 on each side of the gate arm will cause the gate arm to be located in a vertical plane as shown in FIG. 3. If an external force is applied to the lower end of the gate arm, such as by a strong wind, or by the top of a trailer which catches underneath a lowered gate arm, the gate arm will be permitted to swivel about the axis of rod 12 as long as the external force is sufficient to overcome the forces applied by the depending spring legs 46 and 48. However, as soon as the external force is removed, the gate arm will be promptly returned to its position in a vertical plane as shown in FIG. 3 without reliance on gravity.

It will be obvious from FIG. 3 that the gate arm mechanism of the present invention permits the gate arm to swivel through a significant angle in either direction about the axis of rod 12. Regardless of which direction an external force causes the gate arm to rotate or pivot about the axis of rod 12, the spring legs 46 and 48 on opposite sides of the gate arm will cooperate to return the arm to a neutral or vertical position. The gate arm mechanism can be designed to permit a desired maximum amount of swivel of the gate arm 26 about the axis of rod 12. In the embodiment shown in the drawings, the maximum swivel is less than 90 degrees from the vertical position shown in FIG. 3.

Depending on the materials used for the gate arm 26, the steel plates 22 and 30 attached to opposite sides of the gate arm could be eliminated. However, in the preferred embodiment shown, the gate arm is protected on both sides by such steel plates since the gate arm may be made of a softer material such as aluminum or fiberglass which could be damaged due to rubbing thereagainst of the lower ends of the four depending springs legs 46 and 48 on both sides of the gate arm.

Reference is again made to FIG. 3 to illustrate certain mechanical aspects of the spring forces created to maintain the gate arm 26 in the central position shown. The lower ends 84 of the spring legs are approximately ½ inch long (see FIGS. 9 and 10), and it is desirable to maintain those leg portions quite short because they are the portions which engage the gate arm plates 22 and 32 and rub against those plates when the gate arm is moved from its vertical position. If relatively long spring leg portions engage the gate arm plates 22 and 32, increased friction will be created which is undesirable as it impairs the return of the gate arm to its vertical position after an external force has been removed.

It is also important that the spring leg portions 84 engage the gate arm plates 22 and 32 near the lower ends thereof as that results in the spring force being applied to the gate arm a relatively long distance from the rod 12 thereby increasing the moment arm for causing the gate arm to swivel back to its vertical position when an external force is removed. Increasing the length of the spring leg portion 82 will reduce the spring force applied to the gate arm plate for a given size torsion spring, but the spring legs disclosed have been found quite suitable for most gate arms. Longer and heavier gate arms produce more friction and thus are more difficult to swivel about the rod 12. Thus, variations in the number and dimensions of the springs may be required to accommodate various lengths of gate arms.

What is claimed is:

1. A railway gate arm assembly comprising, in combination, a retractable gate arm which extends horizontally in its lowered, traffic blocking position, a retractable longitudinal support member from which said gate arm is suspended, said gate arm being mounted for pivotal movement about a longitudinal axis of said support member so said gate arm can swivel in either direction about said axis upon application of an external force to said gate arm, at least two torsion springs, one mounted adjacent said support member on each side thereof, said torsion springs having coils which extend longitudinally relative to said gate arm, each said torsion spring having at least one depending spring leg which extends downwardly from said coils and engages against a corresponding side of said gate arm to bias said gate arm toward a vertical plane, whereby when an external force causes said gate arm to swivel out of said vertical plane, said depending spring legs will cause said gate arm to return to said vertical plane upon removal of said external force.

2. A railway gate arm assembly as defined in claim 1 where each said torsion spring has at least two of said depending spring legs.

3. A railway gate arm assembly as defined in claim 1 where each said torsion spring has a plurality of coils, there being one of said depending spring legs provided at each end of said plurality of coils.

4. A railway gate arm assembly as defined in claim 1 where a pair of said torsion springs are mounted on each side of said support member.

5. A railway gate arm assembly as defined in claim 1 where each said torsion spring includes a spring loop which is deflected and held out of its at rest position when said torsion spring is installed whereby each said depending spring leg is engaged against a said corresponding side of said gate arm with a predetermined force depending on the amount of deflection of said spring loop from said at rest position.

6. A railway gate arm assembly as defined in claim 1 where each of said depending spring legs extends outwardly from said coils and then extends downwardly and inwardly toward said corresponding side of said gate arm.

7. A railway gate arm assembly as defined in claim 6 where a lowermost end of each said depending spring leg is bent to be approximately vertical and thereby parallel to said corresponding side of said gate arm when the latter is in said vertical plane.

8. A railway gate arm assembly as defined in claim 1 including a pair of spring retainers, one of said spring retainers being mounted adjacent each side of said gate arm and inwardly of said depending spring legs by connection to a swivel bracket to which said support member is also connected, each said spring retainer being movable between an operative position where it holds said depending spring legs spaced from said corresponding side of said gate arm and an inoperative position where it permits said depending spring legs to engage against said corresponding side of said gate arm, said spring retainers being moved to said operable position for purposes of assembly of said gate arm on said support member.

9. A railway gate arm assembly as defined in claim 8 where said each said spring retainer is pivotally movable between a raised operative position and a lowered inoperative position.

10. A railway gate arm assembly as defined in claim 1 where a metal plate is fastened to each side of said gate arm and said depending spring legs engage against corresponding ones of said metal plates.

11. A railway gate arm assembly as defined in claim 1 where said support member includes a rod, and said gate arm has a longitudinal tube connected thereto, said tube being mounted over said rod to suspend said gate arm from said rod.

12. A railway gate arm assembly as defined in claim 11 where each said torsion spring includes a spring loop which is deflected and held out of its at rest position when said torsion spring is installed whereby each said depending spring leg is engaged against a corresponding side of said gate arm with a predetermined force depending on the amount of deflection of said spring loop from said at rest position, and where at least one spring keeper is positioned to extend laterally over said tube to be supported thereby, said spring keeper extending beneath opposing ones of said spring loops to maintain said spring loops in raised positions deflected upwardly from their at rest positions.

13. A railway gate arm assembly as defined in claim 1 including a pair of spring support members positioned above and on each side of said gate arm, said spring support members being connected to a swivel bracket to which said support member is also connected, said spring support members extending longitudinally from said swivel bracket, and said coils of said torsion springs being mounted over corresponding ones of said spring support members for supporting said coils.

14. A railway gate arm assembly as defined in claim 1 where four of said torsion springs are provided, two of said torsion springs being mounted in end-to-end relation on each of said sides of said gate arm, and each said torsion spring having a pair of said depending spring legs to provide four of said depending spring legs in engagement with each said corresponding side of said gate arm.

* * * * *